US005562426A

United States Patent [19]

Watanabe et al.

[11] Patent Number: 5,562,426

[45] Date of Patent: Oct. 8, 1996

[54] SCROLL TYPE REFRIGERANT COMPRESSOR

[75] Inventors: Yasushi Watanabe; Masahiro Kawaguchi, both of Kariya, Japan

[73] Assignee: Kabushiki Kaisha Toyoda Jidoshokki Seisakusho, Aichi, Japan

[21] Appl. No.: 456,937

[22] Filed: Jun. 1, 1995

[30] Foreign Application Priority Data

Jun. 3, 1994 [JP] Japan ..... 6-122258

[51] Int. Cl.[6] ..... F04B 49/00

[52] U.S. Cl. ..... 417/310; 417/295; 417/440

[58] Field of Search ..... 417/295, 299, 417/440, 310; 418/55.1

[56] References Cited

U.S. PATENT DOCUMENTS 4,456,435 6/1984 Hiraga et al. ..... 417/310
5,059,098 10/1991 Suzuki et al. ..... 417/310
5,282,728 2/1994 Swain .

FOREIGN PATENT DOCUMENTS 61-76782 4/1986 Japan .
267381 10/1989 Japan ..... 417/440
4-187886 7/1992 Japan ..... 417/440

*Primary Examiner*—Charles G. Freay
*Attorney, Agent, or Firm*—Burgess, Ryan and Wayne

[57] ABSTRACT

A scroll type refrigerant compressor having an axial housing means defining a discharge chamber and a low pressure chamber around the discharge chamber, a stationary scroll , and a movable scroll. The movable scroll engages the stationary scroll and moves along a predetermined orbiting path respective to the stationary scroll. The stationary and movable scrolls define compression chambers therebetween. The stationary end plate of the stationary scroll includes a pair of relief ports for fluid communication between the compression chamber and the low pressure chamber. The compressor further comprises a valve plate in the form of a ring with a pair of valve ports. The valve plate is rotatable about the axis of the compressor between an open position where the valve port is aligned with the relief port to provide fluid communication between the compression chambers and the low pressure chamber and a closed position where the valve port separates the compression chamber from the low pressure chamber. An actuator for rotating the valve plate between the open position and the closed position in response to a refrigeration demand signal.

12 Claims, 6 Drawing Sheets

SCROLL TYPE REFRIGERANT COMPRESSOR

BACKGROUND OF THE INVENTION (1) Field of the Invention

The present invention relates to a scroll type refrigerant compressor which is adapted to use in the refrigerating system of an automobile.

(2) Description of the Related Art

Japanese Unexamined Patent Publication (Kokai) No. 61-76782 discloses a scroll type refrigerant compressor adapted for use in the refrigerating system of an automobile. The compressor comprises front and rear housings connected to each other, a drive shaft held in the housings for rotation, and an electromagnetic clutch provided on the drive shaft to transmit the power from the automobile engine. The front housing has a suction chamber. The rear housing has a discharge chamber and a low pressure chamber provided around the discharge chamber.

The rear housing accommodates a stationary scroll unit fixedly mounted thereto and a movable scroll unit which engages the stationary scroll unit. The stationary scroll unit comprises a stationary end plate and a spiral member attached to the stationary end plate. The movable scroll unit comprises a movable end plate disposed axially opposite to the stationary end plate, and a movable spiral member attached to the movable end plate. The movable scroll unit is connected to the drive shaft so as to move along an orbiting path.

The stationary and movable scroll units define compression chambers therebetween. The compression chambers shift from the periphery to the central portion of the scroll units due to the orbiting motion of the movable scroll unit. The volume of the moving compression chambers are progressively reduced. Refrigerant gas introduced from the suction chamber into the compression chambers is compressed by the shifting compression chambers to the central portion of the scroll units.

The stationary scroll unit includes relief ports formed in the stationary end plate to communicate the compression chambers with the low pressure chamber. The compressor further comprises a valve plate in the form of a ring member provided on the outer face of the stationary end plate for rotation between a first position and a second position. The valve plate includes passages which are aligned with the relief ports to allow the compression chamber to communicate with the low pressure chamber when the valve plate is at the first position, and to stop the compression chambers communicating with the low pressure chamber when the valve plate is at the second position.

The compressor further comprises an actuator for rotating the valve member in the low pressure chamber. The actuator is provided with a cylinder having a distal end chamber and a proximal end chamber, a piston slidably provided in the cylinder and outwardly extending from the distal end of the cylinder, and a spring in the proximal end chamber for biasing the piston toward the distal end of the cylinder. The outer end of the piston is connected to the valve plate to rotate it to the first position when the piston is advanced from the cylinder, and to the second position when the piston is retracted into the cylinder. The distal end chamber is fluidly connected to the compression chambers via a conduit, and the proximal end chamber is fluidly communicated with the low pressure chamber through a passage in the cylinder wall.

When the compressor starts its operation, the pressure in the compression chamber has not increased, and the piston is advanced from the cylinder by the biasing force of the spring. Thus, the valve plate rotates to the first position to allow the compression chamber to communicate with the low pressure chamber, which reduces the displacement of the compressor and the shock generated at the start of the compressor.

After the start of the compressor, the piston is displaced by the pressure in the distal end chamber of the cylinder when the pressure in the compression chamber reaches a certain pressure level, which is transmitted to the distal end chamber via the conduit. Thus, the valve plate is rotated to the second position to separate the compression chamber from the low pressure chamber, which increases the displacement of the compressor to the maximum.

In the prior art compressor described above, the on-off operation of the compressor is controlled by engaging and disengaging an electromagnetic clutch provided on the drive shaft. Therefore, the prior art compressor must have an electromagnetic clutch, which increase the weight and fuel consumption of the automobile on which the compressor is mounted.

Further, in the prior art compressor described above, there is a problem of frosting on the refrigerating circuit during high speed operation of the compressor, since the compressor cannot function at a reduced displacement.

The invention is directed to a solution of the problem of the prior art.

SUMMARY OF THE INVENTION

According to the invention, there is provided a scroll type refrigerant compressor adapted for use in a refrigerating system of an automobile in which the compressor comprises an axial housing means forming an outer casing of the compressor and defining a refrigerant suction passage means, a discharge chamber, a low pressure chamber provided around the discharge chamber, and a passage for fluidly communicating the low pressure chamber with the suction chamber, the housing means having a longitudinal axis extending substantially at the center portion thereof; a drive shaft held within the axial housing means for rotation about the longitudinal axis; a stationary scroll means fixedly encased in the housing means and having a stationary spiral member and a stationary end plate member attached to an end of said spiral member; a movable scroll means engaged with the stationary scroll means and moving a predetermined orbiting path respective to the stationary scroll means according to the rotation of the drive shaft, the stationary and the movable scroll means defining compression chambers therebetween, the compression chambers moving from the periphery to the center of the scroll means due to the orbiting motion of the movable scroll means, the stationary end plate member including at least a relief port for fluidly communicating the compression chambers with the low pressure chamber; a valve plate member in the form of a ring which includes at least a valve port and is provided for rotation about the axis of the housing means between an open position where the valve port is aligned with the relief port to provide fluid communication between the compression chambers and the low pressure chamber and a closed position where the compression chamber is separated from the low pressure chamber; a means for generating a refrigeration demand signal to operate the compressor; and an actuator means for rotating the valve plate member between the open position and the closed position according to the refrigeration demand signal.

The displacement of the scroll type refrigerant compressor of the invention can be reduced to a minimum displacement during the operation by communicating the compression chamber with the low pressure chamber through the relief port and valve port when it is not necessary to operate the compressor. Therefore the compressor of the invention does not need to be provided with an electromagnetic clutch as in the prior art compressor.

Preferably the scroll type refrigerant compressor of the invention further comprises a valve means in the suction passage means to communicate the suction passage means with the external refrigerating circuit when the refrigeration demand signal is present, and to block the suction passage means from the external refrigerating circuit when the refrigeration demand signal is not present. The compressor can reduce the displacement to zero when it is not necessary to operate the compressor.

In the other embodiment of the invention, the scroll type refrigerant compressor of the invention comprises a valve means to communicate the discharge chamber with the low pressure chamber when the refrigeration demand signal is not present, and to block the discharge chamber from the low pressure chamber when the refrigeration demand signal is present. The compressor can reduce the displacement substantially to zero when it is not necessary to operate the compressor.

Preferably the actuator means comprises a cylinder attached to the housing means and having a distal end chamber and a proximal end chamber therein, a piston slidably provided in the cylinder and outwardly extending from the distal end of the cylinder, and a spring in the proximal end chamber for biasing the piston toward the distal end of the cylinder. The compressor further comprises a control valve means having a first pressure port fluidly connected to the discharge chamber, a second pressure port fluidly connected to the low pressure chamber, and a control port fluidly connected to the proximal end chamber of the cylinder; and a means for controlling the control valve means so as to supply refrigerant gas from the discharge chamber to the proximal end chamber of the cylinder when a refrigeration demand signal is present, and to supply refrigerant gas from the low pressure chamber to the proximal end chamber when the refrigeration demand signal is not present.

DESCRIPTION OF THE PREFERRED EMBODIMENTS

Figure 1:
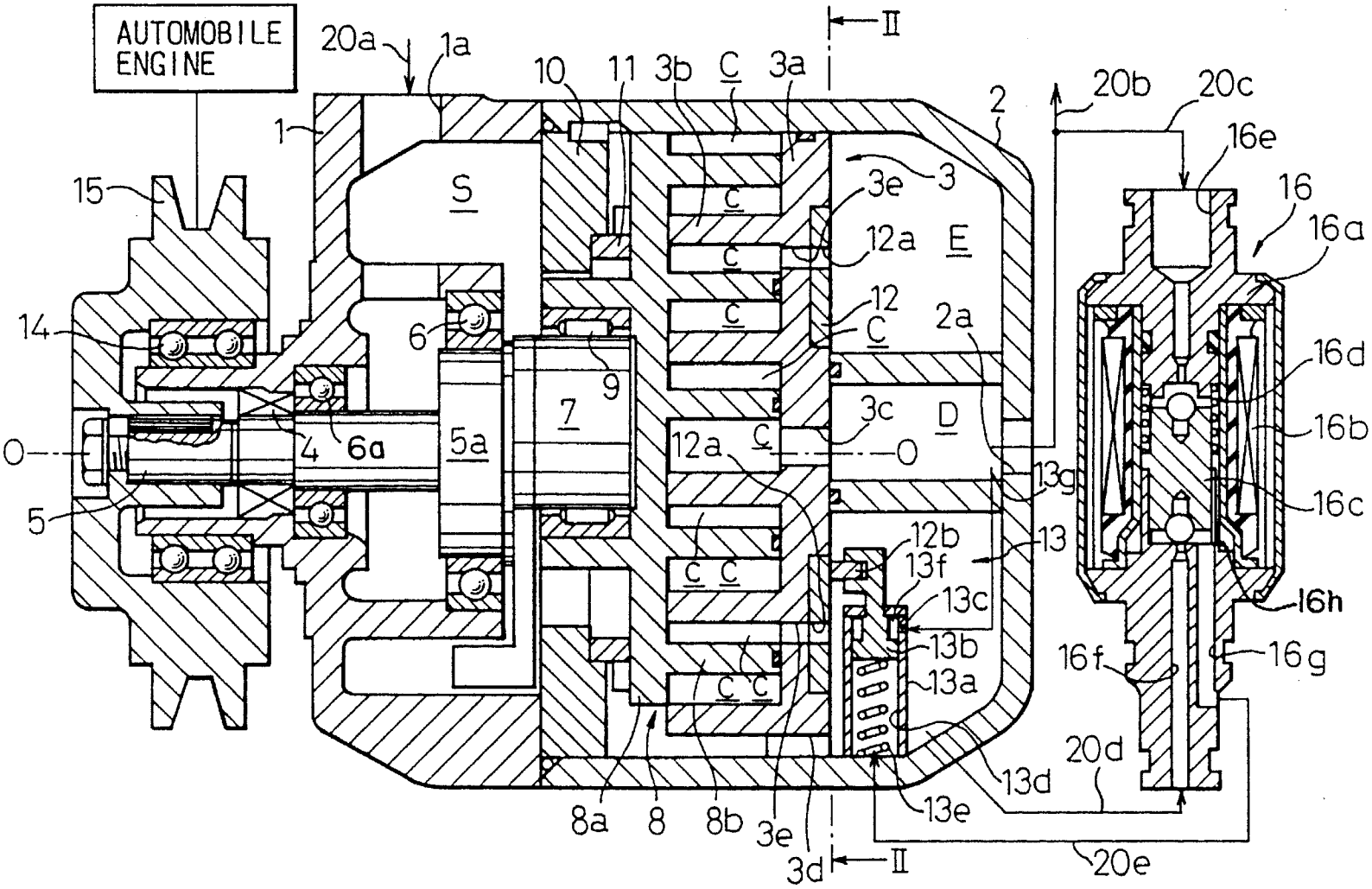
FIG. 1 is a section of the first embodiment of the invention.
Figure 2:
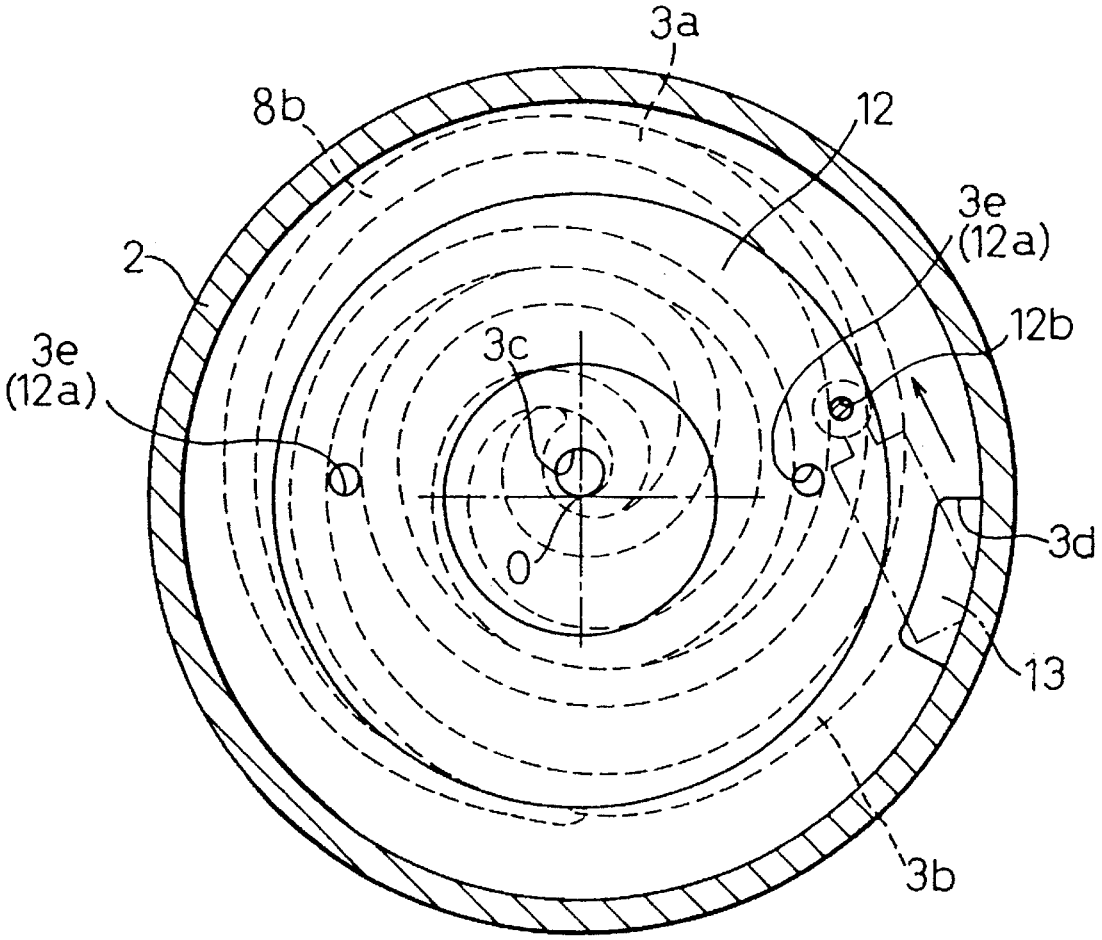
FIG. 2 is a section of the compressor taken along the line II—II in FIG. 1.
Figure 3:
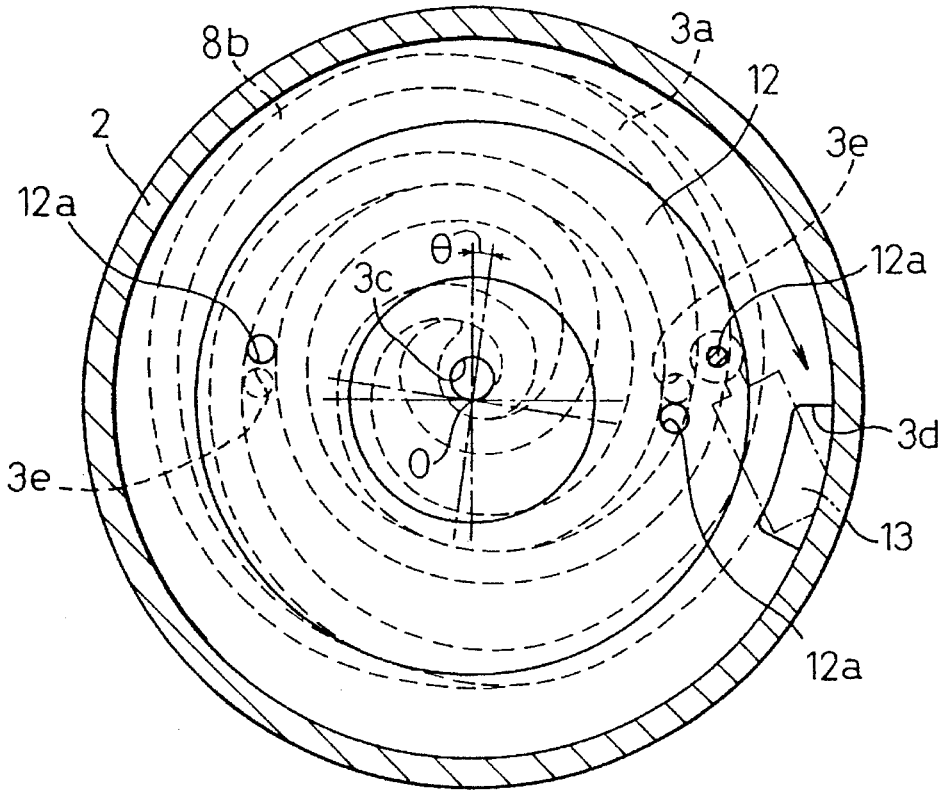
FIG. 3 is a section of the compressor taken along the line II—II in FIG. 1.

With reference to FIGS. 1–3, the first embodiment of the invention is described hereinafter.

A scroll type refrigerant compressor in FIG. 1 comprises a front housing member 1 and a rear housing member 2 connected to the front housing. The front housing member 1 includes a suction chamber S fluidly connected to an external refrigerating circuit (not shown) through an inlet port la and a supply conduit 20*a*.

The compressor is also provided with a stationary scroll unit 3 fixedly attached to the inner face of the rear housing 2. The stationary scroll unit 3 comprises a stationary end plate 3*a* and a stationary spiral member 3*b* in the form of a spirally extending wall member integral with the stationary end plate 3*a*. The stationary spiral member 3*b* may extend along e.g., an involute curve with respect to a given central axis parallel to the longitudinal axis O of the compressor.

The compressor is further provided with a movable scroll unit 8 comprising a movable end plate 8*a* axially opposite to the stationary end plate 3*a*, and a movable spiral member 8*b* in the form of a spirally extending wall member integral with the movable end plate 8*a*. The movable spiral member 8*b* may extend along e.g., an involute curve with respect to a given central axis parallel to the longitudinal axis O of the compressor. The movable scroll unit 8 engages the stationary scroll unit 3 so as to define refrigerant pockets functioning as compression chambers C therebetween.

The compressor is further provided with a drive shaft 5 held in the front housing 1 via a bearing 6*a* for rotation about the longitudinal axis O and a sealing 4. The drive shaft 5 is connected to a pulley 15 which is mounted to the front housing 1 via a bearing 14. The pulley 15 is connected via a belt (not shown) to an automobile engine of the automobile.

The drive shaft 5 has a large diameter portion 5*a* at the inner end thereof. The large diameter portion 5*a* is held in the front housing 1 via a bearing 6 for rotation about the longitudinal axis O of the compressor. An eccentric pin (not shown) is attached to the inner end face of the large diameter portion 5*a*, which pin engages a drive bush 7 connected to the movable scroll unit 8 via a bearing 9.

The compressor is further provided with a stationary ring 10 mounted to the inner surface of the rear housing 2. An Oldham coupling or a slider coupling 11 is provided between the stationary ring 10 and the movable end plate 8*a* for preventing the movable scroll unit 8 from rotation about an axis thereof.

The drive shaft 5 of the compressor is rotated continuously during the operation of the automobile engine. When the drive shaft 5 rotates, the movable scroll unit 8 moves along an orbiting path about the central axis O of the drive shaft 5. The orbiting motion of the movable scroll unit 8 causes gradual shifting of the compression chambers C formed by the stationary and movable scroll units 3 and 8. During the shifting of each of the compression chambers C, the volume thereof is gradually reduced. Thus, the refrigerant gas introduced from the inlet port 1*a* into the compression chambers C through the suction chamber S is gradually compressed therein. The compressed refrigerant gas is discharged into a discharge chamber D, which is described hereinafter, through a discharge port 3*c* when the each of the compression chambers C is shifted to the central portion of the stationary and movable scroll units 3 and 8.

The rear housing 2 includes a discharge chamber D behind the stationary end plate 3*a*. The compressed refrigerant gas in the compression chambers is discharged to the discharge chamber D through a discharge port 3*c* in the stationary end plate 3*a*. The discharge chamber D is fluidly connected to an external refrigerating circuit (not shown)

through an outlet port 2a in the rear housing 2 and a discharge conduit 20b.

The rear housing 2 further includes a low pressure chamber E around the discharge chamber D, and a passage 3d which provides fluid communication between the suction chamber S and the low pressure chamber E.

The stationary end plate 3a includes a pair of relief ports 3e. On the outer end face of the fixed end plate 3a, a valve plate 12 in the form of a ring plate is provided for rotation about the longitudinal axis O of the compressor between an open position and a closed position. The valve plate 12 includes a pair of valve ports 12a such that the valve ports 12a is aligned with the relief ports 3e to fluidly communicate the compression chambers C with the low pressure chamber E when the valve plate 12 is at the open position, and the valve plate 12 separates the compression chambers C from the low pressure chamber E when the valve plate 12 is at the closed position.

An actuator 13 for rotating the valve plate 12 is provided in the rear housing 2. The actuator 13 comprises a cylinder 13a attached to the inner surface of the rear housing 2 at the proximal end thereof, and a piston 13b slidably provided within the cylinder 13a. The cylinder 13a and the piston 13b define a distal end chamber 13f and a proximal end chamber 13d. The distal end chamber 13f is fluidly connected to the discharge chamber D through a port 13c in the cylinder wall and a conduit 13g. A spring 13e for biasing the piston 13b toward the distal end of the cylinder is provided within the proximal end chamber 13d of the cylinder 13a. The outer end of the piston 13b outwardly extends through the distal end chamber 13f of the cylinder 13a. The outer end of the piston 13b is connected to the valve plate 12 via a connecting pin 12b on the outer face thereof.

Figure 7:
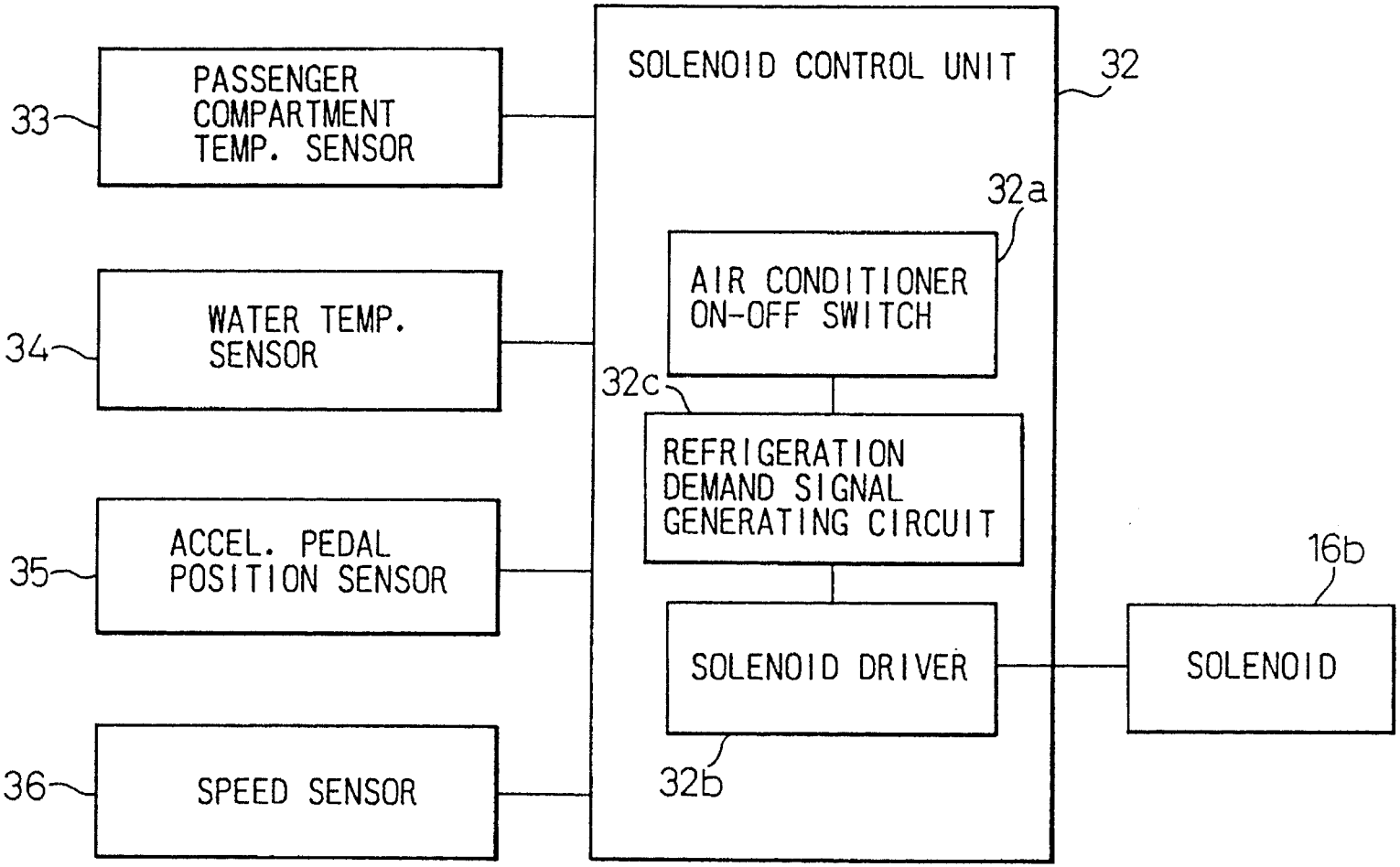
FIG. 7 is a schematic block diagram of the control system for the solenoid of the control valve.

The compressor further comprises a solenoid type control valve 16 and a solenoid control unit 32 (FIG. 7). The control valve 16 comprises a valve housing 16a, a valve spool 16c slidably provided within the valve housing 16a and movable between a first position and a second position, a solenoid 16b for moving the valve spool 16c, and a spring 16d for biasing the valve spool 16c toward the second position. The valve housing 16a includes a first pressure port 16e, a second pressure port 16f and a control port 16g. The first pressure port 16e is fluidly connected to the discharge chamber D through a first pressure conduit 20c connected to the discharge conduit 20b. The second pressure port 16f is fluidly connected to the low pressure chamber E through a second pressure conduit 20d, The control port 16g is fluidly connected to the proximal end chamber 13d of the cylinder 13a through a control conduit 20e.

The solenoid control unit 32 includes a solenoid driver 32b to energize the solenoid 16b, a refrigeration demand signal generating circuit 32c, and an on-off switch 32a for the refrigerating system, such as an air conditioning system provided in the passenger compartment of the automobile. The solenoid 16b is energized by solenoid driver 32b according to the refrigeration demand signal from the refrigeration demand signal generating circuit 32c based on signal from sensors, such as a temperature sensor 33 in a compartment to be refrigerated, such as the passenger compartment, a water temperature sensor 34 provided in the automobile engine, an acceleration pedal position sensor 35, and a speed sensor 36 for detecting the travelling speed of the automobile.

When the solenoid 16b is energized, the valve spool 16c moves to the first position to close the first pressure port 16e. This results in separating the first pressure conduit 20c from the control valve 16, and allowing the second pressure conduit 20d to communicate with the control conduit 20e, whereby the proximal end chamber of the cylinder 13a is fluidly connected to the low pressure chamber E. When the solenoid 16b is deenergized, the valve spool 16 moves to the second position due to the biasing force of the spring 16d to close the second pressure port 16f. This results in separating the second pressure conduit 20d from the control conduit 20e, and allowing the first pressure conduit 20c to communicate with the control conduit 20e through passage 16h in valve housing 16a, whereby the proximal end chamber of the cylinder 13a is fluidly connected to the discharge chamber D.

The functional operation of the compressor according to the first embodiment will be described hereinafter, in which the solenoid 16b of the control valve 16 is controlled based on the signal from the passenger compartment temperature sensor 33 as an example.

When the automobile engine rotates, the drive shaft 5 continuously rotates, and the movable scroll continuously moves along the orbiting path.

When the passenger closes the on-off switch 32a, the solenoid driver 32b is activated to energize the solenoid 16b of the control valve 16. The valve spool 16c moves to the first position to separate the first pressure port 16e from the control port 16g, and to allow the second pressure port 16f to communicate with the control port 16g. This results in connecting the proximal end chamber 13d of the cylinder 13a to the low pressure chamber E.

In the starting phase of the compressor, that is, when the automobile engine starts, the pressure in the discharge chamber D and in the distal end chamber 13f of the cylinder 13a has not been sufficiently increased, which causes the piston 13b to move out the cylinder 13a due to the biasing force of the spring 13e. Thus, the valve plate 12 is rotated so that the valve ports 12a are aligned with the relief ports 3e, which provides fluid communication between the relief ports 3e and the low pressure chamber E. The refrigerant gas in the compression chambers C which communicates with the low pressure chamber E through the relief ports 3e is kept at a pressure level substantially equal to that in the low pressure chamber E. Therefore, the refrigerant gas in the compression chambers C is not substantially compressed until the shifting compression chambers C clear the relief ports 3e, and the displacement of the compressor is reduced. This also results in the reduction of a shock during starting.

When the pressure in the discharge chamber D is increased to a higher pressure level, the pressure in the discharge chamber D passes to the distal end chamber 13f of the cylinder 13a through the conduit 13g. This causes the piston 13b to retract into the cylinder 13a against the biasing force of the spring 13e and the pressure in the proximal end chamber which is substantially equal to that of the low pressure chamber E. Thus, the valve plate 12 is rotated so that the relief ports 3e block the low pressure chamber E and the displacement of the compressor is increased to the maximum displacement.

When the passenger compartment temperature sensor 33 detects that the temperature in the passenger compartment is lower than a reference temperature set by the passenger, the refrigeration demand signal generating circuit 32c does not generate a refrigeration demand signal. Thus, the solenoid driver deenergizes the solenoid 16a to move the valve spool 16c to the second position to block the proximal end chamber 13d of the cylinder 13a from the low pressure chamber E, and to communicate the proximal end chamber with the discharge chamber D. Thus, the piston 13*b* is advanced from the cylinder 13*a* to rotate the valve plate 12 so that the relief ports 3*e* and the valve ports 12*a* are aligned and the compression chambers C fluidly communicates with the low pressure chamber E. Thus, the refrigerant gas in the compression chambers C is not substantially compressed until the shifting compression chambers C clear the relief ports 3*e*, and the displacement of the compressor is reduced.

On the other hand, when the passenger compartment temperature sensor 33 detects that the temperature in the passenger compartment is higher than the reference temperature, the solenoid driver 32*b* energizes the solenoid 16*b*, due to the refrigeration demand signal from the refrigeration demand signal generating circuit 32*c* based on the signal from the temperature sensor 33, to move the valve spool 16*c* to the first position against the biasing force of the spring 16*d* to separate the proximal end chamber 13*d* of the cylinder 13*a* from the discharge chamber D, and to allow the proximal end chamber 13*d* to communicate with the low pressure chamber E. Thus, the piston 13*b* is retracted into the cylinder 13*a* to rotate the valve plate 12 so that the relief ports 3*e* are separated from the low pressure chamber E and the displacement of the compressor is increased to the maximum displacement.

When the passenger opens the on-off switch 32*a*, the solenoid driver 32*b* deenergizes the solenoid 16*b*. This results in rotating the valve plate 12 to the open position where the compression chambers C are able to communicate with the low pressure chamber E, and the displacement of the compressor is reduced to the minimum displacement as described above.

Figure 4:
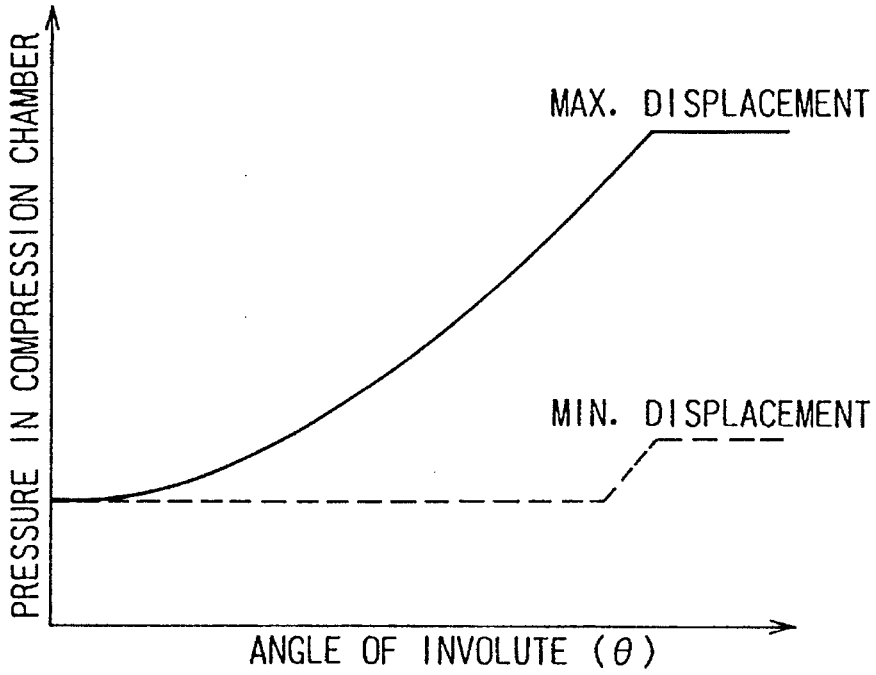
FIG. 4 illustrates the relation between the pressure in the discharge chamber and the angle of the involute.

In the scroll type refrigerant compressor in FIGS. 1–3, the reduction of the displacement can be selected by the position of the relief ports 3*e*. FIG. 4 illustrates the pressure in the compression chambers C relative to the angle θ along the involute curve of the scroll units 3 and 8 from the periphery to the central portion. The pressure in the normal operation, in which the maximum displacement is obtained, is designated by the solid line. The reduced displacement operation by a compressor with relief ports at the angular position $\theta_n$ is designated by the dashed line. It will be understood that the closer the angular position $\theta_o$ is present to the periphery, the closer the displacement shifts to the maximum displacement.

When the piston 13*b* of the actuator 13 is advanced, the valve plate 12 is rotated, and the angular position of the connecting pin 12*b* relative to the attachment point of the cylinder 13*a* is changed. Therefore, in order to Compensate for the change, the cylinder 13*a* can be attached to the rear housing 2 for rotation about the attachment point.

Figure 5:
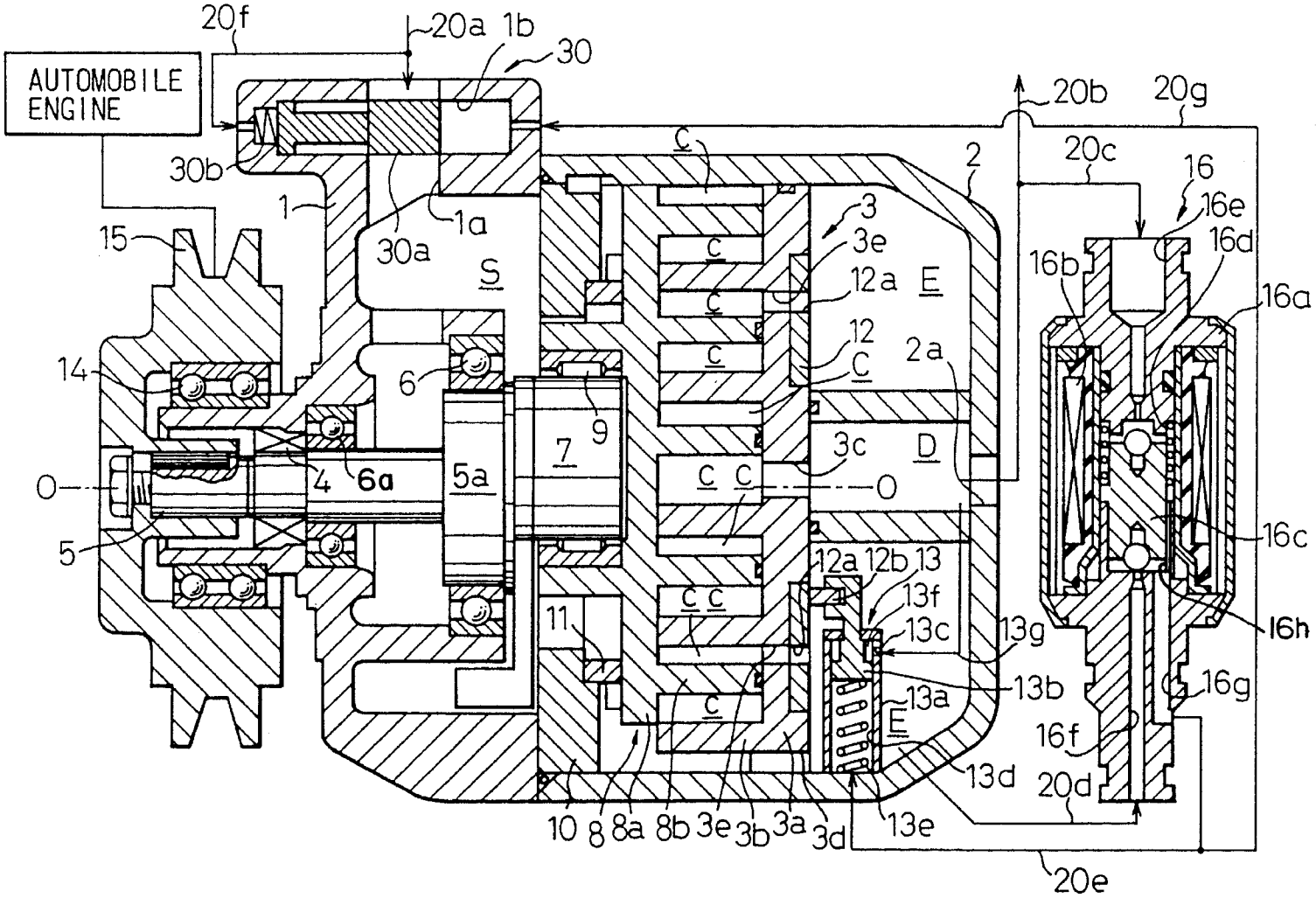
FIG. 5 is a section of the second embodiment of the invention.

With reference to FIG. 5, the second embodiment of the invention will be described hereinafter. The same reference numbers are used for the corresponding elements.

The scroll type refrigerant compressor of FIG. 5 is provided with a shut-off valve 30 at the inlet port 1*a*. The shut-off valve 30 comprises a valve element 30*a* slidably provided within a bore 1*b* in the front housing 1, which bore has first and second ends, and a spring 30*b* for biasing the valve element to the second end. The compressor is further provided with a conduit 20*f* between the supply conduit 20*a* and the first end, and a conduit 20*g* between the control conduit 20*e* and the second end. The spring constant of the spring 30*b* is selected so that the valve element 30*a* is biased to the second end by the spring 30*b* when the pressure in the low pressure chamber E is present at the second end of the bore 1*b*, and the valve element 30*a* moves to the first end when the pressure in the discharge chamber D is present at the second end of the bore 1*b*.

When the passenger compartment temperature sensor 33 detects that the temperature in the passenger compartment is higher than the reference temperature, the solenoid 16*b* is energized to move the valve spool 16*c* of the control valve 16 to the first position to separate the proximal end chamber 13*d* of the cylinder 13*a* from the discharge chamber D and to allow the proximal end chamber 13*d* to communicate with the low pressure chamber E. Thus, piston 13*b* is retracted to rotate the valve plate 12 so that the relief port 3*e* is closed. At the same time, the pressure level in the low pressure chamber E is present on the second end of the bore 1*b* through the conduit 20*g*. Thus, the valve element 30*a* is moved to the second end to communicate the suction chamber S with the supply conduit 20*a*.

On the other hand, when the passenger compartment temperature sensor 33 detects that the temperature in the passenger compartment is lower than the reference temperature, the solenoid 16*b* is deenergized to move the valve spool 16*c* to the second position to separate the proximal and chamber 13*d* of the cylinder 13*a* from the low pressure chamber E, and to allow the proximal end chamber 13*d* to communicate with the discharge chamber D. Thus, piston 13*b* is advanced to rotate the valve plate 12 so that the relief port 3*e* communicates with the valve ports 12*a*. At the same time, the pressure level in the discharge chamber D is present at the second end of the bore 1*b* through the conduit 20*g*. Thus, the valve element 30*a* is moved to the first end to separate the suction chamber from the supply conduit 20*a*. Therefore, no refrigerant gas is supplied to the compressor, that is, the displacement of the compressor is reduced to zero. This can also solve the problem of frosting on the external refrigerating circuit at a high operational speed.

Figure 6:
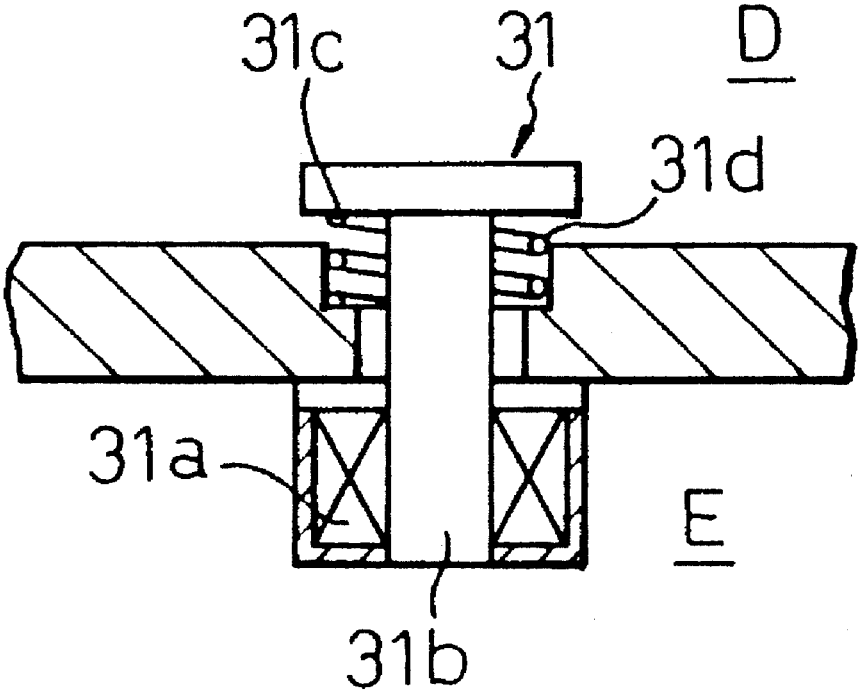
FIG. 6 is a partial section of the third embodiment of the invention illustrating a valve provided in the wall between the discharge chamber and the low pressure chamber.

With reference to FIG. 6, the third embodiment of the invention will be described hereinafter.

FIG. 6 is a partial section of a wall between the discharge chamber D and the low pressure chamber E. In the embodiment of FIG. 6, the compressor is further provided with a solenoid valve 31 on the wall between the discharge chamber D and the low pressure chamber E. The solenoid valve 31 comprises a valve element 31*b* provided within a through hole in the wall between the two chambers D and E for linear motion between an open position and a closed position, a spring 31*d* for biasing the valve element 31*b* to the open position, and a solenoid 31*a* to move the valve element 31*b* to the closed position. The solenoid 31*a* is also electrically connected to the solenoid control unit 32. The constitution Of the compressor is otherwise the same as the first embodiment.

When the passenger compartment temperature sensor 33 detects that the temperature in the passenger compartment is lower than the reference temperature, the solenoid 16*b* of the control valve 16 is deenergized to rotate the valve plate 12 so that the relief port 3*e* communicates with the valve ports 12*a*. At the same time, the solenoid 31*a* is deenergized to move the valve element 31*b* to the open position. The refrigerant gas in the discharge chamber D is introduced into the low pressure chamber E through the solenoid valve 31. Therefore, substantially no refrigerant gas is discharged to the external refrigerating circuit, that is, the displacement of the compressor is reduced to substantially zero. This can also solve the problem of frosting on the external refrigerating circuit at the high operational speed.

In the preceding embodiments, the actuator 13 and the shut-off valve 30 are controlled by the pressure in the discharge chamber D. However, the actuator 13 and the shut-off valve 30 can be provided with electric motors (not shown) which are controlled by an electrical signal from an external circuit. Further, the solenoid valve 31 can be controlled independently of the control valve 16.

In the preceeding embodiments, the solenoid 16*b* of the control valve 16 is controlled based on the signal from the passenger compartment temperature sensor 33. However, in order to stabilize the operation of the automobile engine during the warming-up phase, the solenoid 16*b* can be controlled by the signal from the water temperature sensor 34 in the engine. Further, to obtain the maximum power of the automobile engine for acceleration, the solenoid 16*b* can also be controlled by the signal from the acceleration pedal position sensor 35 in combination with the signal from the speed sensor 36.

Further, the compressor can be provided with means for adjusting the degree of the opening between the relief ports 3*e* and the valve port 12*a* to control the displacement of the compressor.

What is claimed is:

1. A scroll type refrigerant compressor adapted for use in a refrigerating system of an automobile in which the compressor comprises:

an axial housing means forming an outer casing of the compressor and defining a refrigerant suction passage means, including a suction chamber, a discharge chamber, a low pressure chamber provided around the discharge chamber, and a passage for fluidly communicating the low pressure chamber with the suction chamber, the housing means having a longitudinal axis extending substantially at the center portion thereof;

a drive shaft held within the axial housing means for rotation about the longitudinal axis;

a stationary scroll means fixedly encased in the housing means and having a stationary spiral member and a stationary end plate member attached to an end of said spiral member;

a movable scroll means engaged with the stationary scroll means movable in a predetermined orbiting path respective to the stationary scroll means according to the rotation of the drive shaft, the stationary and the movable scroll means defining compression chambers therebetween, the compression chambers moving from the periphery to the center of the scroll means due to the orbiting motion of the movable scroll means, the stationary end plate member including at least a relief port for fluid communication between the compression chambers and the low pressure chamber;

a valve plate member in the form of a ring which includes at least a valve port and is rotatable about the axis of the housing means between an open position where the valve port is aligned with the relief port to provide fluid communication between the compression chambers and the low pressure chamber and a closed position where the compression chamber is separated from the low pressure chamber;

a means for generating a refrigeration demand signal to operate the compressor; and an actuator means for rotating the valve plate member between the open position and the closed position in response to the refrigeration demand signal.

2. A scroll type refrigerant compressor according to claim 1 in which the compressor further comprises a valve means in the suction passage means having a first position to separate the suction passage means from an external refrigerating circuit and a second position in response to the refrigeration demand signal to allow communication between the suction passage means and the external refrigerating circuit.

3. A scroll type refrigerant compressor according to claim 1 in which the compressor further comprises a valve means having a first position which allows the discharge chamber to communicate with the low pressure chamber and a second position in which the discharge chamber is separated from the low pressure chamber in response to the refrigeration demand signal.

4. A scroll type refrigerant compressor according to claim 1 in which the actuator means comprises a cylinder attached to the housing means and having a distal end chamber and a proximal end chamber therein, a piston slidably provided in the cylinder and outwardly extending from the distal end of the cylinder, and a spring in the proximal end chamber for biasing the piston toward the distal end of the cylinder;

the compressor further comprising a control valve having a first pressure port fluidly connected to the discharge chamber, a second pressure port fluidly connected to the low pressure chamber, and a control port fluidly connected to the proximal end chamber of the cylinder; and a means for controlling the control valve in a first position to supply refrigerant gas from the discharge chamber to the proximal end chamber of the cylinder in response to the refrigeration demand signal, and a second position to supply refrigerant gas from the low pressure chamber to the proximal end chamber.

5. A scroll type refrigerant compressor according to claim 4 in which the means for generating the refrigeration demand signal comprises a signal generating circuit responsive to an on-off switch of the refrigerating system, the refrigeration demand signal being in an active state when the on-off switch is closed and refrigeration demand signal being in an inactive state when the on-off switch is opened.

6. A scroll type refrigerant compressor according to claim 5 in which the means for generating the refrigeration demand signal further comprises a temperature sensor provided in a compartment to be refrigerated, the refrigeration demand signal being in an active state when the temperature sensor detects that the temperature in the passenger compartment is higher than a reference temperature, and the refrigeration demand signal is in an inactive state when the temperature sensor detects that the temperature in the compartment is lower than the reference temperature.

7. A scroll type refrigerant compressor according to claim 6 in which the control valve means further comprises a valve spool movably provided between a first position where the valve spool separates the first pressure port from the control port and allows the second pressure port to communicate with the control port, and a second position where the valve spool separates the second pressure port from the control port and allows the first pressure port to communicate the control port;

a spring for biasing the spool to the second position;

a solenoid for moving the valve spool, the valve spool being moved to the first position against the biasing force of the spring when the solenoid is energized; and a means for controlling the control valve means comprising a solenoid driver for energizing the solenoid, said solenoid driver energizing the solenoid in response to the refrigeration demand signal.

8. A scroll type refrigerant compressor according to claim 1 in which the drive shaft is continuously operatively connected to an engine of the automobile.

9. A scroll type refrigerant compressor adapted for use in a refrigerating system of an automobile in which the compressor comprises:

an axial housing means forming an outer casing of the compressor and defining a refrigerant suction passage means, including a suction chamber, a discharge chamber, a low pressure chamber provided around said discharge chamber, and a passage for a fluid communication between the low pressure chamber and the suction chamber, the housing means having a longitudinal axis extending at substantially the center portion thereof;

a drive shaft held within the axial housing means for rotation about the longitudinal axis;

a stationary scroll means fixedly encased in the housing means and having a stationary spiral member and a stationary end plate member attached to an end of said spiral member;

a movable scroll means engaging the stationary scroll means and moving along a predetermined orbiting path respective to the stationary scroll means according to the rotation of the drive shaft, the stationary and movable scroll means defining compression chambers therebetween, the compression chambers shifting from the periphery to the center of the scroll means by the orbiting motion of the movable scroll means, the stationary end plate member including at least a relief port for fluid communication between the compression chambers and the low pressure chamber;

a valve plate member in the form of a ring which includes at least a valve port and is rotatable about the axis of the housing means between an open position where the valve port is aligned with the relief port to provide fluid communication between the compression chambers and the low pressure chamber and a closed position where the valve port separates the compression chamber from the low pressure chamber;

a means for generating a refrigeration demand signal to operate the compressor;

an actuator means for rotating the valve plate member between the open position and the closed position in response to the refrigeration demand signal, the actuator means comprising a cylinder attached to the housing means and having a distal end chamber and a proximal end chamber therein, a piston slidably provided in the cylinder and outwardly extending from the distal end of the cylinder and a spring in the proximal end chamber for biasing the piston toward the distal end of said cylinder;

a control valve having a first pressure port fluidly connected to the discharge chamber, a second pressure port fluidly connected to the low pressure chamber, and a control port fluidly connected to the proximal end chamber of said cylinder; and a means for controlling the control valve in a first position to supply refrigerant gas from the discharge chamber to the proximal end chamber of said cylinder in response to the refrigeration demand signal, and in a second position to supply refrigerant gas from the low pressure chamber to the proximal end chamber.

10. A scroll type refrigerant compressor according to claim 9 in which the compressor further comprises a valve means in the suction passage means having a first position to allow the suction passage means to communicate with an external refrigerating circuit in response to the refrigeration demand signal, and a second position to separate said suction passage means from the external refrigerating circuit.

11. A scroll type refrigerant compressor according to claim 9 in which the compressor further comprises a valve means having a first position to allow the discharge chamber to communicate with the low pressure chamber, and a second position to separate the discharge chamber from said low pressure chamber in response to the refrigeration demand signal.

12. A scroll type refrigerant compressor according to claim 9 in which the drive shaft is continuously operatively connected to an engine of the automobile.

* * * * *